US007689142B2

(12) United States Patent
Kita et al.

(10) Patent No.: US 7,689,142 B2
(45) Date of Patent: Mar. 30, 2010

(54) IMAGE FORMING APPARATUS, AND PROCESSING UNIT AND LATENT IMAGE WRITING DEVICE MOUNTED THEREIN

(75) Inventors: Nobuhiko Kita, Osaka (JP); Ryoh Idehara, Hyougo (JP); Kazuyoshi Kondo, Osaka (JP); Tadashi Okano, Tokyo (JP); Genta Hagiwara, Tokyo (JP); Kaoru Tada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 50 days.

(21) Appl. No.: 11/758,973

(22) Filed: Jun. 6, 2007

(65) Prior Publication Data

US 2008/0050146 A1 Feb. 28, 2008

(30) Foreign Application Priority Data

Aug. 28, 2006 (JP) ..... 2006-230084

(51) Int. Cl.
*F21V 21/084* (2006.01)

(52) U.S. Cl. ..... 399/107; 399/110; 399/116; 399/117

(58) Field of Classification Search ..... 399/107, 399/110, 111, 116, 117
See application file for complete search history.

(56) References Cited

U.S. PATENT DOCUMENTS 6,785,502 B2 8/2004 Kondoh
7,162,182 B2 * 1/2007 Tonges et al. ..... 399/110
7,379,687 B2 * 5/2008 Kawasumi ..... 399/110
2004/0101328 A1 * 5/2004 Kimura et al. ..... 399/111
2005/0214023 A1 * 9/2005 Foster et al. ..... 399/110
2007/0110473 A1 5/2007 Kondo et al.
2007/0110475 A1 5/2007 Idehara et al.

FOREIGN PATENT DOCUMENTS

CN 1126842 7/1996

(Continued)

OTHER PUBLICATIONS

U.S. Appl. No. 11/623,477, filed Jan. 16, 2007, Ryoh Idehara et al.

*Primary Examiner*—Sandra L O'Shea
*Assistant Examiner*—Evan Dzierzynski
(74) *Attorney, Agent, or Firm*—Oblon, Spivak, McClelland, Maier & Neustadt, L.L.P.

(57) ABSTRACT

An image forming apparatus capable of suppressing drop in the write positional accuracy of the optical write while improving the maintenancability of the photosensitive bodies and the peripheral devices thereof, having a printer comprising four processing units each holding, in the inner part thereof, a photosensitive body for supporting a latent image on an endless moving surface, an optical write unit that is movable between an operate position where a write operation is performed for writing latent images on the surface of each of these photosensitive bodies and a retreat position where this write operation is not performed, and a support body for supporting each of the photosensitive bodies of the processing units and the optical write unit, the support body being configured as an integrally molded part by being united at the location for supporting each of the photosensitive bodies of the processing units and the location for supporting the optical write unit from (front-side panel and rear-side panel).

16 Claims, 7 Drawing Sheets

FOREIGN PATENT DOCUMENTS

| | | |
|---|---|---|
| JP | 4-110874 | 4/1992 |
| JP | 6-102742 | 4/1994 |
| JP | 7-209943 | 8/1995 |
| JP | 7-333541 | 12/1995 |
| JP | 2849978 | 11/1998 |
| JP | 2004-109658 | 4/2004 |

* cited by examiner

IMAGE FORMING APPARATUS, AND PROCESSING UNIT AND LATENT IMAGE WRITING DEVICE MOUNTED THEREIN

BACKGROUND OF THE INVENTION

1. Field of the Invention

The present invention relates to an image forming apparatus comprising a latent image carrier for carrying a latent image on an endless moving surface and a latent image writing device movable between an operation position where the write operation is performed for writing a latent image on this surface and a retreat position where the write operation is not performed. In addition, the present invention relates to a processing unit and latent image writing device mounted in this image forming apparatus.

2. Description of the Related Art

In the widely adopted conventional electrophotographic-type image forming apparatus configuration a latent image is written on a latent image carrier such as a uniformly charged photosensitive body by means of a latent image writing device such as a laser writing device that performs an optical scanning operation employing a laser beam. Depending on the layout thereof, the latent image writing device of this kind of image forming apparatus serves as an obstruction to the maintenancability of the various peripheral devices including the latent image carrier and the development device arranged in the periphery thereof.

Japanese Patent No. 2849978 describes an image forming apparatus in which a latent image writing device is supported by means of an open/close cover openable relative to a fixed cover which constitutes a part of the box-shaped body of the image forming apparatus, the latent image writing device being widely separated from the latent image carrier accompanying the opening of the open/close cover. According to this configuration, the latent image writing device is caused to retreat from a position opposing the latent image carrier accompanying the opening of the open/close cover exposing the latent image carrier and the peripheral devices thereof to the exterior whereupon, accordingly, the maintenancability thereof is improved.

However, in this image forming apparatus, error in the relative positioning between the latent image writing device supported by the open/close cover and the latent image carrier supported by the fixed cover is produced as a result of the play and so on that exists in the open/close cover relative to the fixed cover. An additional problem inherent thereto pertains to a drop in write positional accuracy of the latent image writing device caused by this error. This same problem is liable to occur due to play of the latent image writing device in configurations in which the latent image writing device does not move accompanying the opening and closing of the open/close cover but rather the latent image writing device is moved independently or together with some other member.

Technologies relating to the present invention are also disclosed in, e.g.:

Japanese Laid-open Patent Application. No. H04-110874,

Japanese Laid-open Patent Application. No. H06-102742, and

Japanese Laid-open Patent Application. No. H07-333541.

SUMMARY OF THE INVENTION

With the foregoing in mind, it is an object of the present invention to provide an image forming apparatus and a processing unit and latent image writing device mounted in this image forming apparatus in which drop in write positional accuracy of the latent image writing device can be suppressed while improving the maintenancability of the latent image carrier and peripheral devices thereof.

In an aspect of the present invention, an image forming apparatus comprises latent image carrier for carrying a latent image on an endless moving surface; a latent image writing device that is movable between an operate position where a write operation for writing a latent image on this surface is performed and a retreat position where this write operation is not performed; and a support body for supporting the latent image carrier and the latent image writing device. The support body is configured as an integrally molded part by being unified at a location for supporting the latent image carrier and a location for supporting the latent image writing device.

In another aspect of the present invention, a processing unit comprises a latent image carrier for carrying a latent image on an endless moving surface; a charge device for uniformly charging the surface; a latent image writing device for writing a latent image on the surface; and a developing device for developing the latent image carried on the latent image carrier. In an image forming apparatus the latent image writing device is mounted to be movable between an operation position where a write operation is performed and a retreat position. At least the latent image carrier, charge device and development device are held in a common holding body as a single unit that is integrally detachable relative to an image forming apparatus main body. The latent image carrier of the processing unit is supported together with the latent image writing device, in the image forming apparatus, by an integrally molded part of a support body for support thereof.

In another aspect of the present invention, a latent image writing device comprises a latent image carrier for carrying a latent image on an endless moving surface; a charge device for uniformly charging the surface; and a latent image writing device for writing a latent image on the surface. In an image forming apparatus the latent image writing device is mounted to be movable between an operation position where a write operation is performed and a retreat position, and the latent image writing device is supported together with the latent image carrier, in the image forming apparatus, by an integrally molded part of a support body for support thereof.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

An embodiment of an electrophotographic-type printer (hereinafter referred to simply as the printer) serving as the image forming apparatus in which the present invention has application will be hereinafter described.

First, the fundamental configuration of the printer will be described.

Figure 1:
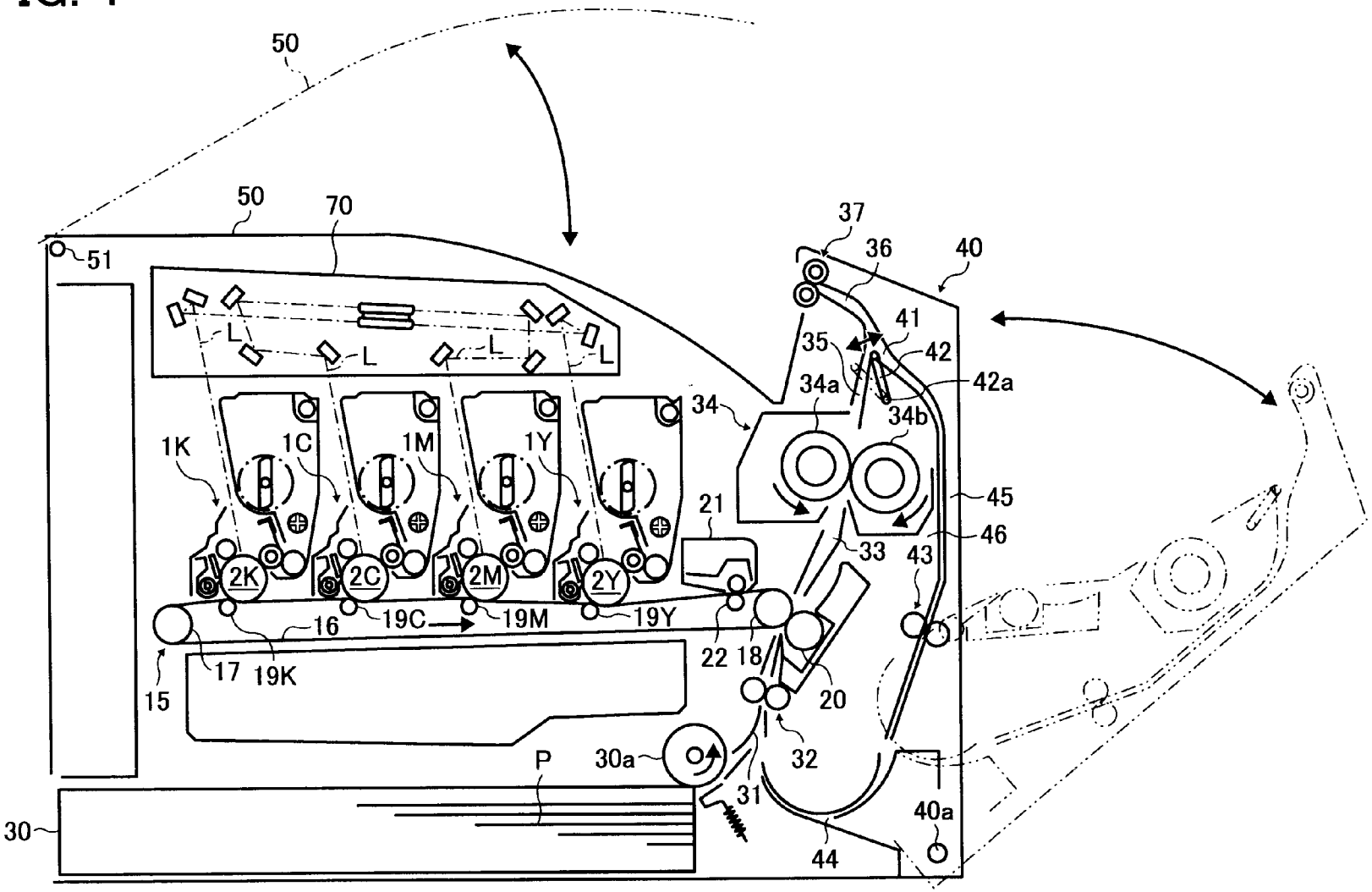
FIG. 1 is a schematic diagram of a printer pertaining to an embodiment of the present invention.
Figure 2:
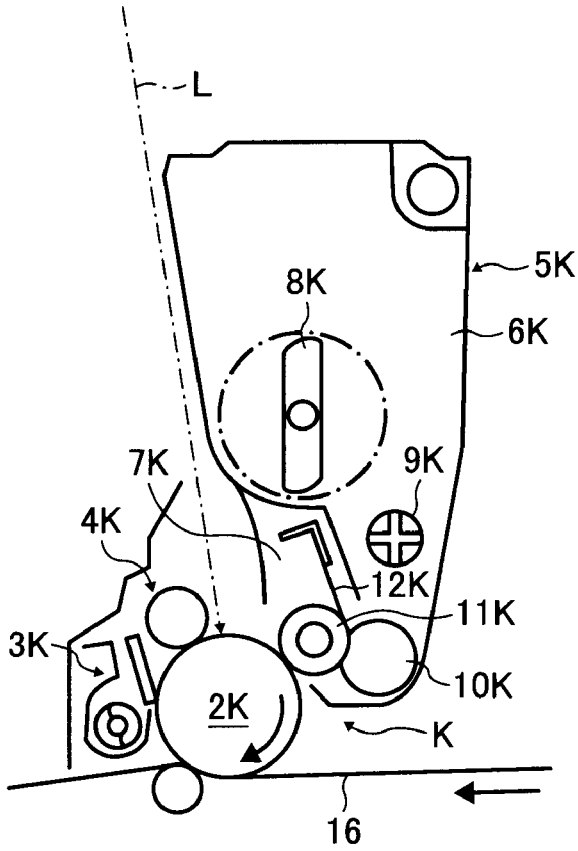
FIG. 2 is a schematic diagram of the configuration of a K processing unit of this printer.

FIG. 1 is a schematic block diagram of the printer. The printer shown in this diagram comprises four processing units 1Y, M, C, K for forming toner images of yellow, magenta, cyan and black (hereinafter indicated as Y, M, C and K). Although these processing units employ different color toners of Y, M, C, K as image forming materials, they are otherwise identical in configuration and are replaced at the end of their lifespan. Taking the processing unit 1K for forming a K toner image as an example, as shown in FIG. 2, this processing unit comprises a drum-like photosensitive body 2K that serves as a latent image carrier, a drum cleaning device 3K, a decharging device (not shown in the diagram), a charging device 4K, and a development device 5K and so on. The processing unit 1K constitutes an image forming unit detachable from the printer main body and is a consumable component part that can be replaced in its entirety.

The charging device 4K uniformly charges the surface of the photosensitive body 2K which is rotated in the clockwise direction in the diagram by drive means not shown in the diagram. The surface of the uniformly charged photosensitive body 2K carries a K electrostatic image produced thereon as a result of exposure scanning by a laser beam L. This K electrostatic image is developed as a K toner image by the development device 5K employing a K toner not shown in the diagram. This is then intermediate-transferred onto a later-described intermediate transfer belt 16. The drum cleaning device 3K removes the residual transfer toner that is attached to the surface of the photosensitive body 2K following the intermediate transfer step. In addition, the decharger device decharges the residual charge of the photosensitive body 2K following cleaning. This decharging initializes the photosensitive body 2K in readiness for the formation of a next image. Other (Y, M, C) toner images are similarly formed on the photosensitive bodies (2Y, M, C) by the other color processing units (1Y, M, C) and intermediate-transferred onto the later-described intermediate transfer belt 16.

The development device 5K comprises a vertical hopper part 6K that houses the K toner not shown in the diagram and a development part 7K. An agitator 8K rotationally driven by drive means not shown in the diagram, an agitation paddle 9K therebelow in the vertical direction rotationally driven by drive means not shown in the diagram, and a toner supply roller 10K therebelow in the vertical direction rotationally driven by drive means not shown in the diagram and so on are arranged in the hopper part 6K. The K toner in the hopper part 6K is moved by gravity to the toner supply roller 10K while being agitated by the rotationally driven agitator 8K and agitation paddle 9K. The toner supply roller 10K comprises a roller part configured from a metal core whose surface is coated with a foamed resin or the like, the roller part being rotated with the K toner of the hopper part 6K attached to the surface thereof.

A development roller 11K that rotates while abutting against the photosensitive body 2K and the toner supply roller 10K and a layer-thinning blade 12K whose tip end abuts against the surface of the development roller are arranged in the development part 7K of the development device 5K. The K toner attached to the toner supply roller 10K of the hopper part 6K is supplied to the surface of the development roller 11K at the part where the development roller 11K abuts against the toner supply roller 10K. When the supplied K toner passes through the position where the layer-thinning blade 12K abuts against the roller accompanying the rotation of the development roller 11K, the layer thickness thereof on the roller surface is regulated. Thereupon, subsequent to this regulation of layer thickness, the K toner attaches to the K electrostatic latent image on the surface of the photosensitive body 2K in the development region which constitutes the part where the development roller 11K abuts against the photosensitive body 2K. The K electrostatic image is developed on the K toner image by the attachment of the toner in this way.

While the process performed by the K processing unit is described above with reference to FIG. 2, Y, M, C toner images are formed on the photosensitive bodies 2Y, M, C by the Y, M, C processing units 1Y, M, C by an identical process.

In FIG. 1 referred to previously, an optical write unit 70 is arranged above the processing units 1Y, M, C, K in the vertical direction. The optical write unit 70, serving as a latent image writing device, optically scans the photosensitive bodies 2Y, M, C, K of the processing units 1Y, M, C, K using a laser beam L emitted from a laser diode in accordance with image information. As a result of this optical scanning, Y, M, C, K electrostatic latent images are formed on the photosensitive bodies 2Y, M, C, K. The optical write unit 70 polarizes the laser beam (L) emitted from the light source in the scanning direction using a polygon mirror rotationally driven by a polygon motor not shown in the diagram, and irradiates this beam onto the photosensitive bodies by way of a plurality of optical lenses and mirrors.

A transfer unit 15 in which an endless intermediate transfer belt 16 is endlessly moved in a tensioned state in the anticlockwise direction in the diagram is arranged below the processing units 1Y, M, C, K in the vertical direction. Apart from the intermediate transfer belt 16, the transfer unit 15 comprises a drive roller 18, an auxiliary roller 17, four primary transfer rollers 19Y, Y, M, C, K, a secondary transfer roller 20, a belt cleaning device 21, and a cleaning backup roller 22 and so on.

The intermediate transfer belt 16 is tensioned by the drive roller 18, the auxiliary roller 17, the cleaning backup roller 22 and the four primary transfer rollers 19Y, M, C, K arranged on the inner side of the loop thereof. In addition, it is endlessly moved in the anticlockwise direction by a rotational force produced by the drive roller 18 driven in this same direction in the diagram by drive means not shown in the diagram.

The intermediate transfer belt 16 endlessly moved in this way is pinched between the four primary transfer rollers 19Y, M, C, K and the photosensitive bodies 2Y, M, C, K. This pinching forms Y, M, C, K primary transfer nips where the photosensitive bodies 2 Y, M, C, K abut against the upper surface of the intermediate transfer belt 16.

A primary transfer bias is applied to each of the primary transfer rollers 19Y, M, C, K by a transfer bias power source not shown in the diagram and, as a result, a transfer electric field is formed between the electrostatic latent images of the photosensitive bodies 2Y, M, C, K and the primary transfer rollers 19Y, M, C, K. A transfer charger or transfer brush or the like may be used instead of the primary transfer rollers 19Y, M, C, K.

When the Y toner formed on the surface of the photosensitive body 2Y of the Y processing unit 1Y advances to the Y primary transfer nip described above accompanying the rotation of the photosensitive body 2Y, a primary transfer thereof onto the intermediate transfer belt 16 from the photosensitive body 2Y occurs due to the action of the transfer electric field and the nip pressure. When the intermediate transfer belt 16 onto which the Y toner image has been primary transferred in this way passes through the M, C, K primary transfer nip accompanying the endless movement thereof, the M, C, K toner images on the photosensitive bodies 2M, C, K are sequentially superposed and primary transferred onto the Y toner image. This superposed primary transfer forms a 4-color toner image on the intermediate transfer belt 16.

The intermediate transfer belt 16 is pinched between a secondary transfer roller 20 of the transfer unit 15 arranged on the loop outer side of the intermediate transfer belt 16 and the auxiliary roller 17 of the loop inner side. This pinching forms a secondary transfer nip where the secondary transfer roller 20 abuts against the upper surface of the intermediate transfer belt 16. A secondary transfer bias is applied by a transfer bias power source not shown in the diagram to the secondary transfer roller 20. The application of this transfer bias being forms a secondary transfer electric field between the secondary transfer roller 20 and the earthed auxiliary roller.

A paper supply cassette 30 that houses a plurality of recording paper P overlapped in a ream state is arranged below the transfer unit 15 in the vertical direction so as to be slidably detachable from the box-shaped body of the printer. A paper supply roller 30*a* abuts against the uppermost recording paper P of the ream of the paper supply cassette 30 whereupon, by the rotation thereof at a predetermined timing in the anti-clockwise direction in the direction of the diagram, the recording paper P is fed to a paper supply path 31.

A resist roller pair 32 is arranged in the end region of the paper supply path 31. The rotation of the two rollers of the resist roller pair 32 is stopped immediately upon the recording paper P fed out from the paper supply cassette 30 being pinched by the rollers. The rotational drive of the pinched recording paper P is restarted at a timing that ensures the pinched recording paper P is brought into phase with the 4-color toner images on the intermediate transfer belt 16 of the secondary dimension transfer nip described above, whereupon the recording paper P is fed out to the secondary transfer nip.

The 4-color toner image on the intermediate transfer belt 16 closely adhered to the recording paper P by the secondary transfer nip is secondary-transferred in its entirety onto the recording paper P due to the effect of the secondary transfer electric field and the nip pressure whereupon, in association with the white color of the recording paper P, a full color toner image is formed. When the recording paper P on the surface of which a full color toner image is formed in this way passes through the secondary transfer nip it is self-stripped from the secondary transfer roller 20 and the intermediate transfer belt 16. Thereupon, by way of a post-transfer conveying path 33, it is fed into a later-described fixing device 34.

Transfer residual toner not transferred onto the recording paper P attaches to the intermediate transfer belt 16 subsequent to it having passed through the secondary transfer nip. This is cleaned from the belt surface by the belt cleaning device 21 that abuts against the upper surface of the intermediate transfer belt 16. The cleaning backup roller 22 arranged in the loop inner side of the intermediate transfer belt 16 performs a back up cleaning of the cleaning of the belt performed by the belt cleaning device 21 from the loop inner side.

The fixing device 34 forms a fixing nip between a fixing roller 34*a* in which a heat-emitting source such as a halogen lamp not shown in the diagram is assembled and a pressure roller 34*b* rotated while being abutted thereagainst at a predetermined pressure. The recording paper P fed into the fixing device 34 is pinched by this fixing nip so that the non-fixed toner image carrier surface thereof is closely adhered to the fixing roller 34*a*. The effect of the applied heat and pressure softens the toner of the toner image and, as a result, the full color image is fixed.

Figure 8:
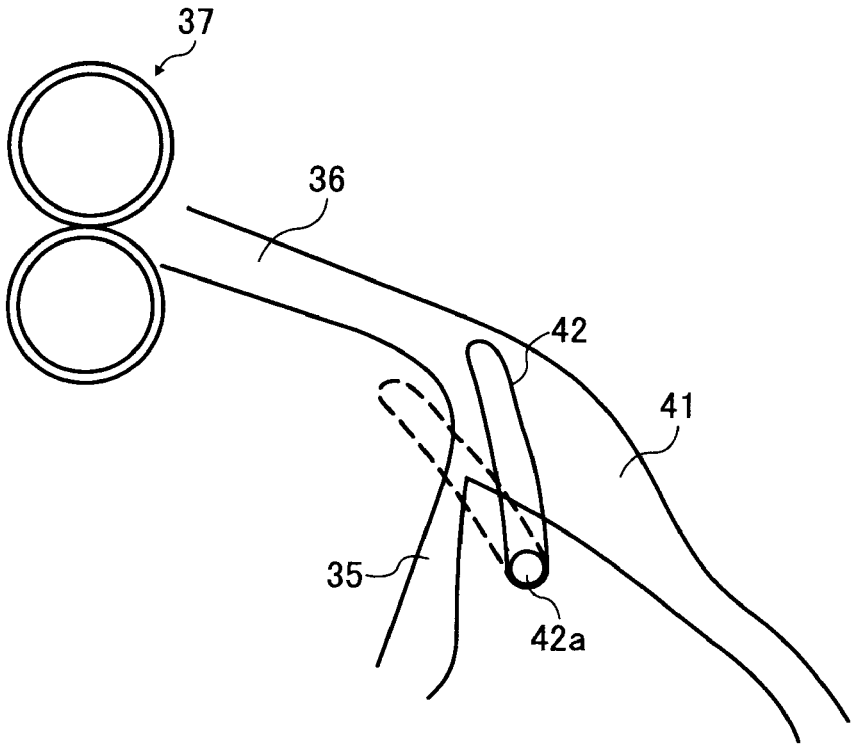
FIG. 8 is a diagram of a changeover pawl and the peripheral configuration thereof of this printer.

The recording paper P discharged from the fixing device 34 passes along a post-fixed conveying path 35 where it then approaches a branching point between a discharge paper path 36 and a pre-inversion conveying path 41. A changeover pawl 42 turnably driven about a turning shaft 42*a* is arranged in the side of the post-fixed conveying path 35, the end region of the post-fixed conveying path 35 being closed and opened as a result of the turning thereof. As shown in FIG. 8, the changeover pawl 42 is stopped at the turning position shown by the solid line at a timing at which the recording paper P is fed from the fixing device 34 to open the end part region of the post-fixed conveying path 35. Accordingly, the recording paper P is advanced from the post-fixed conveying path 35 into the discharge paper path 36 and is pinched between the rollers of the discharge paper roller pair 37.

When a single side print mode is set by means of an input operation performed on a ten-key operating part or the like not shown in the diagram or a control signal or the like sent from a personal computer or the like not shown in the diagram, the recording paper P pinched between the discharge paper roller pairs 37 is discharged to the exterior of the apparatus without further alteration thereto. Thereafter, it is stacked in a stack part at the upper surface of an upper cover 50 of the box-shaped body.

When set to a two-sided print mode and subsequent to the rear-end side of the recording paper P conveyed along the discharge paper path 36 having passed through the post-fixed conveying path 35 with the front-end side pinched between the discharge paper roller pair 37, the changeover pawl 42 is turned to the position of the broken line shown in the diagram to close the end region of the post-fixed conveying path 35 whereupon, in addition, a passage from the discharge paper path 36 to the pre-inversion conveying path 41 is linked by the changeover pawl 42. Essentially simultaneously therewith, a reverse rotation of the discharge paper roller pair 37 is initiated. Subsequent thereto, the recording paper P is conveyed with the rear-end side now at the head thereof and is advanced into the pre-inversion conveying path 41.

FIG. 1 shows the front-face side of the printer. The fore-front side in the direction orthogonal to the paper surface of the diagram is the front face of the printer and the rearward side is the rear face thereof. In addition, the right side in the diagram of the printer is the right face and the left side is the left face thereof. The right-end part of the printer constitutes an inversion unit 40 that is openable and closeable relative to the box-shaped body main body as a result of being turned about a turning shaft 40*a*. When the discharge paper roller pair 37 is reversely rotated, the recording paper P is advanced into the pre-inversion conveying path 41 of the inversion unit 40 and carried in the vertical direction from the upper side to the lower side. Thereupon, after passing between the rollers of an inverse conveying roller pair 43, the paper is advanced into an inverse conveying path 44 that curves in a semi-circular shape. Furthermore, accompanying the conveyance thereof along this curved shape with the upper and lower surfaces being inverted, the direction of advancement in the vertical direction is also inverted from the upper side to the lower side whereupon the paper is carried in the vertical direction from the lower side to the upper side. Subsequently thereto, after passing through the paper supply path 31 described above, the paper is advanced again into the secondary transfer nip. A full color image in its entirety is secondary-transferred onto the other surface thereof and then the paper is discharged to the exterior of the apparatus by way of, in sequence, the post-transfer conveying path 33, the fixing device 34, the post-fixing conveying path 35, the discharge paper path 36 and the discharge paper roller pair 37.

The above-described inversion unit 40 comprises an outer cover 45 and an oscillating body 46. More specifically, the outer cover 45 of the inversion unit 40 is supported to turn about the turning shaft 40*a* provided in the box-shaped body of the printer main body. As a result of the turning thereof, the outer cover 45 is opened and closed relative to the box-shaped body together with the oscillating body 46 held in the inner part thereof. As indicated by the broken line in the diagram, when the outer cover 45 is opened together with the oscillating body 46 of the interior thereof, the paper supply path 31 formed between the inversion unit 40 and the printer main body side, the secondary transfer nip, the post-transfer conveying path 33, the fixing nip, the post-fixed conveying path 35 and the discharge paper path 36 are bisected in the vertical direction and exposed to the exterior. As a result, paper that is jammed in the paper supply path 31, the secondary transfer nip, the post-transfer conveying path 33, the fixing nip, the post-fixed conveying path 35, or the discharge paper path 36 can be easily removed.

In addition, in the opened state of the outer cover 45, the oscillating body 46 is supported by the outer cover 45 to turn about an oscillating shaft not shown in the diagram provided in the outer cover 45. When the oscillating body 46 is opened relative to the outer cover 45 as a result of the turning thereof, the pre-inversion conveying path 41 and inverse conveying path 44 are vertically bisected and exposed to the exterior. As a result, paper that is jammed in the pre-inversion conveying path 41 and inverse conveying path 44 can be easily removed.

As shown by the arrow in the diagram, the upper cover 50 of the box-shaped body of the printer is rotatably supported about the turning shaft 51, a state in which this cover is opened relative to the box-shaped body being established by rotation thereof in the anticlockwise direction in the diagram. This allows he upper opening of the box-shaped body to be widely exposed to the exterior. As a result, the optical write unit 70 is exposed.

The characterizing configuration of the printer will be hereinafter described.

Figure 3:
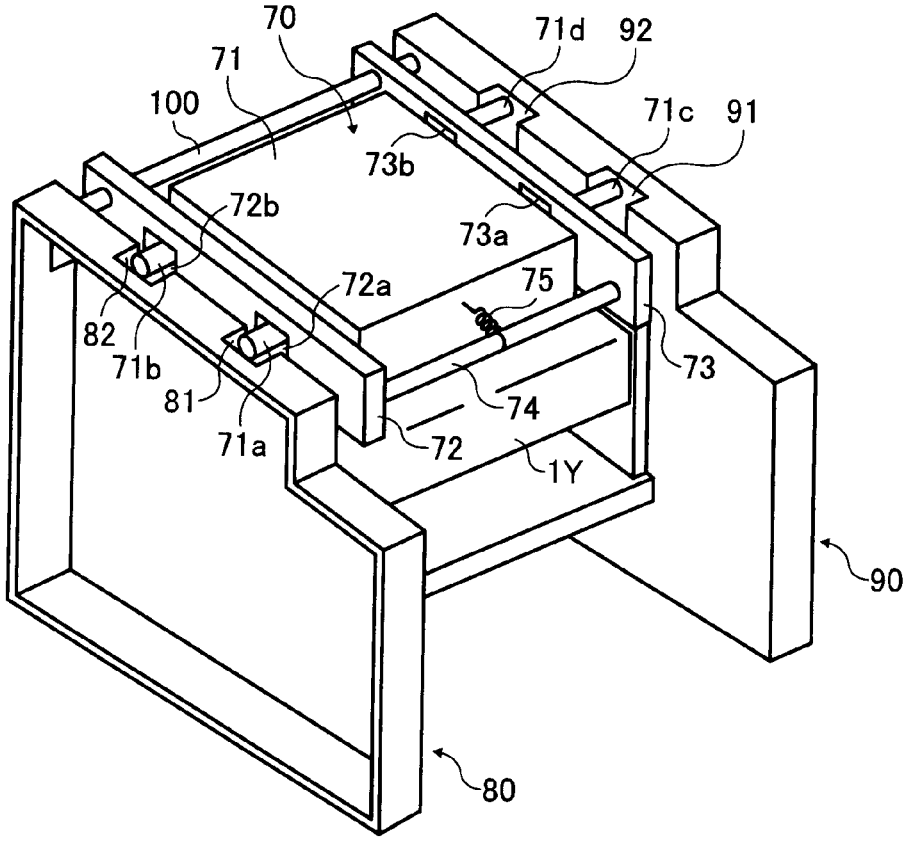
FIG. 3 is a perspective view of the inner configuration of this printer.

FIG. 3 shows the inner configuration of the printer. A main body frame for supporting various component parts is arranged upright in the box-shaped body of the printer, the main body frame being configured from a front-side panel 80, a rear-side panel 90, a shaft 100, a left-side panel and a beam panel not shown in the diagram. The front-side panel 80 constitutes a side panel arranged in the front-face side of the box-shaped body of the printer. In addition, the rear-side panel 90 constitutes a side panel arranged in the rear-face side of the frame of the printer. The front-side panel 80 and the rear-side panel 90 linked by the left-side panel not shown in the diagram are provided and opposing with a predetermined distance therebetween. In addition, the front-side panel 80 and the rear-side panel 90 are linked by the beam panel not shown in the diagram arranged therebetween.

Along with the optical write unit 70 serving as latent image forming means and so on, the transfer unit and four processing units not shown in the diagram are arranged between the relatively opposing front-side panel 80 and the rear-side panel 90 with predetermined distance therebetween. Only the right-most side Y processing unit 1Y of the four processing units is visible in this diagram. The other processing units are located directly below the optical write unit 70 and, accordingly, are not visible in the diagram.

In FIG. 1 referred to previously, because the four processing units 1Y, M, C, K are located directly below the optical write unit 70 provided in the uppermost position thereabove of each, they are not visible from above even when the upper cover 50 of the box-shaped body is opened. In addition, because of the obstruction created by the optical write unit 70 in this way, maintenance operations cannot be carried out on the processing units through the upper opening exposed by the opening of the upper cover 50.

Thereupon, in this printer, in order to expose the processing units, the optical write unit 70 is retreated in accordance with need from the operate position directly above the four processing units 1Y, M, C, K.

In FIG. 3, a front-side first optical positioning groove 81 and a front-side second optical positioning groove 82 sunk to predetermined depths are formed in alignment from the right side to the left side of the printer on an upper end part of the front-side panel 80 with a predetermined distance therebetween. In addition, on the upper part of the rear-side panel 90 a rear-side first optical positioning groove 91 and a rear-side second optical positioning groove 92 sunk to predetermined depths are formed in alignment from the right side to the left side of the printer with a predetermined distance therebetween.

The optical write unit 70 comprises a polygon motor not shown in the diagram, a casing 71 in which an optical system configured from a polygon mirror, reflection mirror and lens and so on is assembled, front frame 72, rear frame 73, right linking rod 74, tension coil spring 75 and left coupling rod not shown in the diagram and so on. The optical write unit main body is configured from the casing 71 and the various component parts assembled therein.

The front frame 72 and rear frame 73 of the optical write unit 70 are coupled at the right-side end part region thereof by the right linking rod 74 so as to be opposing with a predetermined distance therebetween in the front-to-back direction of the printer. In addition, the left-side end part region thereof is coupled by the left coupling rod not shown in the diagram. The casing 71 is held between the front frame 72 and the rear frame 73.

A front-side first positioning shaft 71*a* and front-side second positioning shaft 71*b* protrude in alignment from the front-side face of the casing 71 of the optical write unit 70 with a predetermined distance from the right side to the left side of the printer. In addition, the rear-side first positioning shaft 71*c* and rear-side second positioning shaft 71*d* protrude in alignment from the rear-side face of the casing 71 with a predetermined distance from the right side to the left side of the printer.

The front frame 72 comprises a first opening 72*a* and a second opening 72*b* aligned with a predetermined distance from the right side to the left side of the printer. In addition, the front-side first positioning shaft 71*a* that protrudes from the front-side face of the casing 71 penetrates the first opening 72*a*, and the front-side second positioning shaft 71*b* that protrudes from the front-side face of the casing 71 penetrates the second opening 72*b*.

In addition, the rear frame 73 comprises a first opening 73*a* and a second opening 73*b* aligned with a predetermined distance from the right side to the left side of the printer. The rear-side first positioning shaft 71*c* that protrudes from the rear-side face of the casing 71 penetrates the first opening 73*a*, and the rear-side second positioning shaft 71*d* that protrudes from the rear-side face of the casing 71 penetrates the second opening 73*b*.

The casing 71 is held by the front frame 72 and rear frame 73 and so on as a result of the openings of the front frame 72 and the rear frame being penetrated by the positioning shafts of the casing 71 of the optical write unit 70 in this way with a degree of play. Moreover, the first opening 72*a* and second opening 72*b* of the front frame 72 and the first opening 73*a* and second opening 73*b* of the rear frame 73 describe an elliptical-shaped opening in which the ends of U-shaped notch portions provided in the frame are closed by notch end part closing members. These notch end part closing members are screwed to the frame and can be detached therefrom by an unscrewing operation thereof. When the casing 71 is set between the front frame 72 and the rear frame 73, each of the notch end part closing members are removed from the frame to form "U"-shaped notch part openings. The positioning shafts of the frame are inserted into the "U"-shaped notch parts, and then the notch end part closing members are affixed to form the notch part openings.

One end side of the tension coil spring 75 is fixed to the center in the longitudinal direction of the right-side linking rod 75 that couples the front frame 72 and the rear frame 73. The other end side of the spring 74 is fixed to the right-side face of the casing 71. As a result, the casing 71 between the front frame 72 and the rear frame 73 is pulled from the left side to the right side of the printer. This pulling, prior to the optical write unit 70 being set in the printer, results in the casing 71 being stopped a position where the front-side first positioning shaft 71*a* collides with a right inner wall of the first opening 72*a* of the front frame 72 and the rear-side first positioning shaft 71*c* collides with a right inner wall of the first opening 73*a* of the rear frame 73.

The shaft 100 shown in the diagram spanning between the front-side panel 80 and rear-side panel 90 of the main body frame serving as support bodies is still not apparent when the optical write unit 70 is set in the printer. In this state, the optical write unit 70 is fitted between the front-side panel 80 serving as a first support part and the rear-side panel 90 serving as a second support part of the support body. At this time, the front-side first positioning shaft 71*a* of the casing 71 of the optical write unit 70 is inserted in the front-side first optical positioning groove 81 of the front-side panel 80. In addition, the front-side second positioning shaft 71*b* of the casing 71 is inserted in the front-side second optical positioning groove 82 of the front-side panel 80. In addition, the rear-side first positioning shaft 71*c* of the casing 71 is inserted in the rear-side first optical positioning groove 91 of the rear-side panel 90. Furthermore, The rear-side second positioning shaft 71*d* of the casing 71 is inserted in the rear-side second optical positioning groove 92 of the rear-side panel 90.

The shaft 100 is inserted upon fitting of the optical write unit 70 between the front-side panel 80 and the rear-side panel 90 in this way. More specifically, the shaft 100 is passed through a shaft hole not shown in the diagram provided in the front-side panel 80, a shaft hole not shown in the diagram provided in the front frame of the optical write unit 70, a shaft hole not shown in the diagram provided in the rear frame thereof, and a shaft hole not shown in the diagram provided in the rear-side panel 90. A front-side end part of the shaft 100, to the front-side panel 80, and a rear-side end part thereof, to the rear-side panel 90, are fixed by means of a flange, E-ring and insert pin and so on. As a result, the positioning shafts (71*a* to *d*) of the casing 71 of the optical write unit 70 come into contact with a right-side inner wall of respectively corresponding optical positioning grooves (81, 82, 91, 92) and, accordingly, the casing 71 is positioned. Similarly, the front-side end part as the end part of one end side of the casing 71 is supported by the front-side panel 80 and, in addition, the rear-side end part as the end part of the other end side thereof is supported by the rear-side panel 90.

Figure 4:
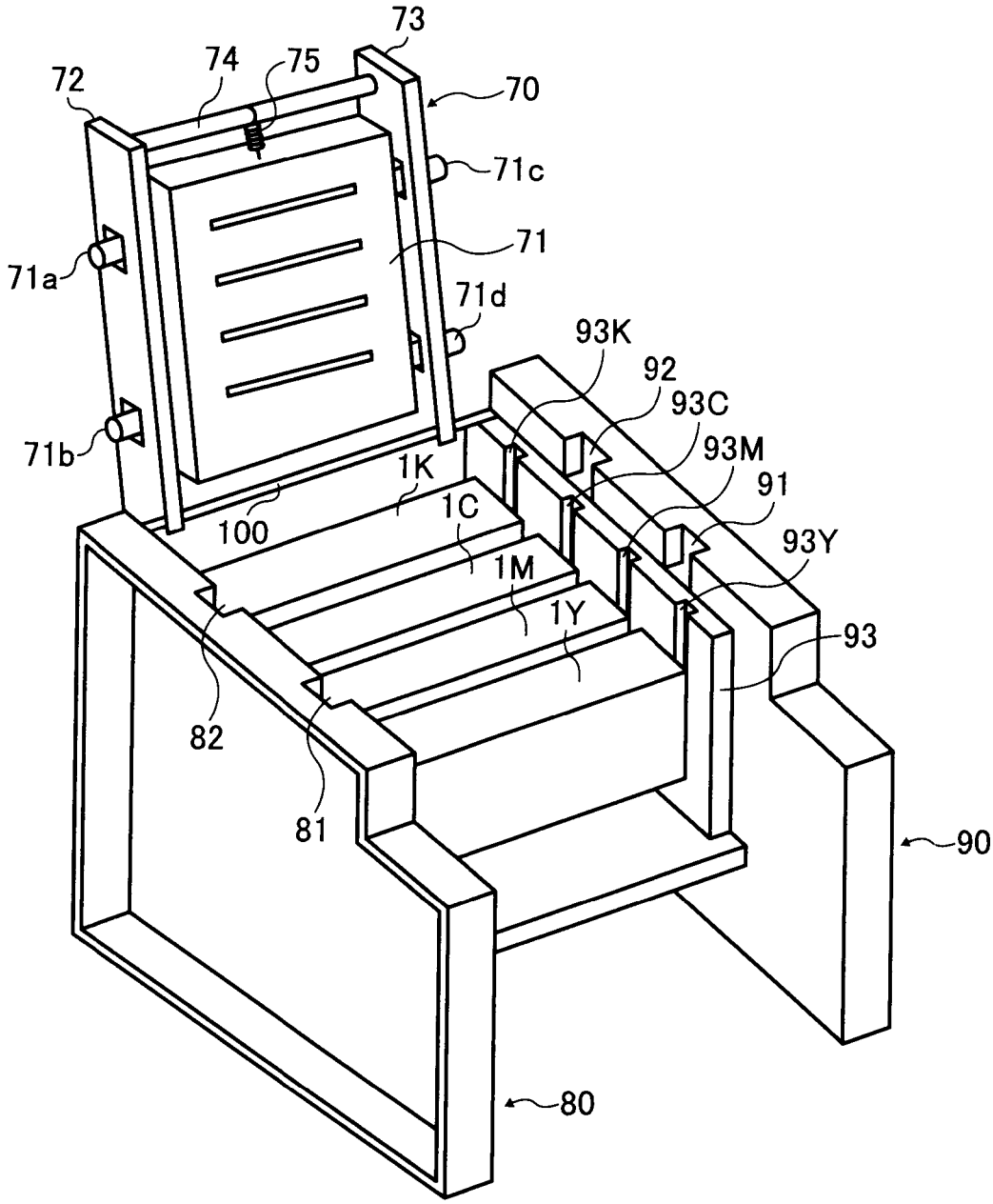
FIG. 4 is a perspective view of the inner configuration of the printer showing a state in which an optical write unit has been retreated to a retreat position.

The optical write unit 70 set between the front-side panel 80 and rear-side panel 90 can be slidably turned relative to the shaft 100 and about the shaft 100 that constitutes a shaft member between the support body that spans between the front-side panel 80 which is a first support part and the rear-side panel 90 which is a second support part. More specifically, the diameter of the positioning shafts (71*a* to *d*) of the casing 71 is formed smaller than the thickness of the respectively correspondent optical positioning grooves (81, 82, 91, 92). However the optical write unit 70, in the state shown in the diagram in which it is set in the operate position, comes into contact with the right-inner wall of the optical positioning groove as a result of being pulled to the right side of the printer by the urging forces of an urging coil spring 75. When the optical write unit 70 is rotated in the anticlockwise direction about the shaft 100 from the state shown in the diagram, the positioning shafts (71*a* to *d*) of the casing 71, while rubbing the left-inner wall of the respectively correspondent optical positioning grooves (81, 82, 91, 92), move within the grooves from the lower side in the vertical direction to a receiving side whereupon, in time, they exit the grooves. In addition, as shown in FIG. 4, the optical write unit 70 retreats to the retreat position which is roughly equivalent to an 11 o'clock position and is latched at this position by a latch mechanism not shown in the diagram. As a result, the four processing units 1Y, M, C, K positioned directly below the optical write unit 70 are exposed.

A rear-side imaging support part 93 is provided to protrude from the rear-side panel 90 in an opposing face to the front-side panel 80. The rear-side imaging support part 93 is integrally molded with the main body of the rear-side panel 90, the main body and the rear-side imaging support part 93 being both configured from a resin. Four rear-side imaging positioning grooves 93Y, M, C, K are formed in the rear-side imaging support part 93 extending from a top end to a bottom end thereof. While not shown in the diagram, an identical front-side imaging support part comprising four front-side imaging positioning grooves is formed in the front-side panel 80 of the main body frame in an opposing face to the rear-side panel 90.

Figure 5:
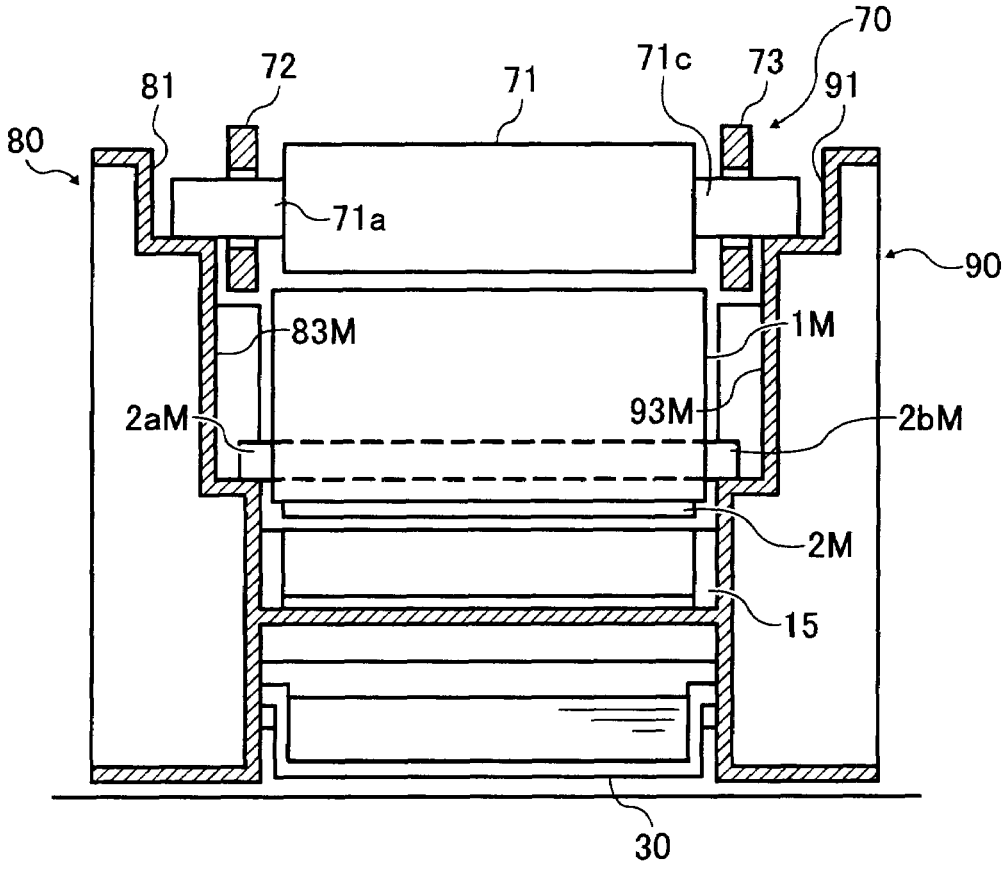
FIG. 5 is a lateral cross-sectional view of the inner configuration of this printer.

Each of the photosensitive bodies (2Y, M, C, K) not shown in the diagram of the four processing units 1Y, M, C, K comprise a cylindrical drum part, and a front drum shaft and a rear drum shaft which are shaft parts that protrude from each of the two end faces of the drum part in the axial line direction thereof. The processing units 1Y, M, C, K pass through shaft holes not shown in the diagram provided in the casing thereof, the front drum shaft and the rear drum shaft thereof jutting out from the casing exterior. More specifically, as shown in FIG. 5, using the M processing unit 1M as an example, passing through a shaft hole not shown in the diagram provided in a front wall of the casing, a front drum shaft 2*a*M of the photosensitive body 2M of the casing unit juts out forward of the casing. In addition, passing through a shaft hole not shown in the diagram provided in the rear wall of the casing, a rear drum shaft 2*b*M of the photosensitive body 2M of the casing juts out rearward of the casing. In addition, with the front drum shaft 2*a*M being engaged with an M front-side imaging positioning groove 83M of the front-side imaging support part of the front-side panel 80 of the main body frame, a rear drum shaft 2*b*M is engaged with an M rear-side imaging positioning groove 93M of the rear-side imaging support part of the rear-side panel 90 of the main body frame. The M processing unit 1M is positioned as a result of this engagement and, in addition, the front-side end part as an end part of one end side thereof is supported by the front-side panel 80 while the rear-side end part as an end part of the other end side is supported by the rear-side panel 90. The other color processing units (1Y, C, K) are similarly positioned and supported by the front-side panel 80 and rear-side panel 90.

In this way, each of the photosensitive bodies (2Y, M, C, K) serving as latent image carriers employed in this printer comprise a drum part which constitutes a columnar-shaped column part, and a front drum shaft and rear drum shaft as shaft parts that protrude from the two ends thereof respectively in the axial line direction thereof. In addition, the front-side panel 80 which constitutes a first support part that while rotatably supporting the front drum shaft which serves as a shaft part of one end side of the photosensitive bodies supports the optical write unit 70 serving as the latent image writing device at the front side as one end side thereof is employed as an integrally molded part of the main body frame that serves as the support body. The rear-side panel 90 which constitutes a second support part that while rotatably supporting the rear drum shaft which serves as a shaft part of the other end side of the photosensitive bodies supports the rear side as the other end side of the optical write unit 70 is also employed thereas. The front drum shaft of the photosensitive bodies and the front side of the optical write unit 70 are supported by the front-side panel 80 which constitutes an integrally molded part of the main frame. In addition, the rear drum shaft of the photosensitive bodies and the rear side of the optical write unit 70 are supported by the rear-side panel 90 which constitutes an integrally molded part of the main body frame. In this configuration, compared to the photosensitive bodies and the optical write unit 70 being supported as separate entities with play therebetween, a drop in the optical write positional accuracy of the optical write unit 70 at the front side in the axial line direction of the photosensitive bodies caused by relative positioning error between the photosensitive bodies and the optical write unit 70 in the front side or rear side of the printer can be suppressed. The integrally molded part referred to here describes a member formed by integral molding of a metal or resin in the same mold. Two members produced in different molds and coupled by means such as an adhesion or welding or the like do not constitute an integrally molded part.

As shown in FIG. 4, the colored processing units 1Y, M, C, K are widely exposed as a result of the optical write unit 70 being caused to retreat to the retreat position and, accordingly, they are readily detachable. These processing units 1Y, M, C, K are replaced with new processing units when the toner of the development devices thereof is exhausted.

As shown in FIG. 1, the printer is provided with Y, M, C, K four photosensitive bodies 2Y, M, C, K serving as latent image carriers, each of the front drum shafts as shaft parts of one end side thereof being rotatably supported by the front-side panel 80 (see FIG. 4) serving as the first support part. In addition, each of the rear drum shafts as shaft parts of the other end side of these photosensitive bodies 2Y, M, C, K are rotatably supported by the rear-side panel 90 serving as the second support part. The printer further comprises a transfer unit (15) as transfer means for the superposed transferring of each of the Y, M, C, K toner images formed as developed visible images on these photosensitive bodies 2Y, M, C, K onto an intermediate transfer belt (16) serving as the transfer body. In this configuration, as a result of the support of the photosensitive bodies 2Y, M, C, K and the optical write unit 70 afforded by each of the front-side panel 80 and the rear-side panel 90 provided as integrally molded parts, drop in write positional accuracy caused by relative positioning error between the two can suppressed and, in turn, relative position displacement (color displacement) of the toner images on the intermediate transfer belt (16) can be suppressed.

In addition, the front-side panel 80 of this printer is configured so that the front drum shafts of the photosensitive bodies 2Y, M, C, K are slidably moved to the operate position of the optical write unit 70 and engaged with the front-side imaging positioning grooves 83Y, M, C, K and, in addition, so that the front drum shafts slide-moved a predetermined distance to the operate position are detached from the top end part of the front-side imaging positioning grooves 83Y, M, C, K to release the engagement thereof with the front drum shafts. Furthermore, the rear-side panel 90 is configured to so that the rear drum shafts of the photosensitive bodies 2Y, M, C, K are slidably moved to the operate position of the optical write unit 70 and engaged with the rear-side imaging positioning grooves 93Y, M, C, K and, in addition, so that the rear drum shafts slide-moved a predetermined distance to the operate position are detached from the top end part of the rear-side imaging positioning grooves 93Y, M, C, K to release the engagement thereof with the rear drum shafts. In this configuration, by slide movement of the photosensitive bodies 2Y, M, C, K to the operate position where there is no obstruction caused by turning of the optical write unit 70 and slide movement in the reverse direction thereto, the photosensitive bodies 2Y, M, C, K can be easily detached relative to the front-side panel 80 and rear-side panel 90.

In addition, the optical write unit 70 employed in this printer is able to write latent images on each of the four photosensitive bodies 2Y, M, C, K using a single unit. In this configuration, unlike a configuration in which specialist latent image writing devices for performing optical writing on each of the photosensitive bodies 4Y, M, C, K are separately provided, the optical writing position on each of the photosensitive bodies 2Y, M, C, K can be determined on the basis of positioning performed using a single unit. As a result, the positioning operation and latent image writing device setting operation can be simplified and, in turn, the maintenancability thereof can be improved.

An imaginary line segment is drawn in the optical write unit 70 of FIG. 4 referred to previously between parts to be supported that connects the front-side first positioning shaft 71*a* serving as the first support part that while in contact with the front-side panel 80 is supported by the front-side panel 80 and the rear-side first positioning shaft 71*c* serving as the second support part that while in contact with the rear-side panel 90 is supported by the rear-side panel 90. In addition, an imaginary line segment is drawn between parts to be supported that connects the front-side second positioning shaft 71*b* serving as the first support part that while in contact with the front-side panel 80 is supported by the front-side panel 80 and the rear-side second positioning shaft 71*d* serving as the second support part that while in contact with the rear-side panel 90 is supported by the rear-side panel 90. In addition, an imaginary line segment is drawn between two end parts of the latent image carrier connecting the front drum shaft and the rear drum shaft of each of the photosensitive bodies. These imaginary line segments extend in the horizontal direction in a mutually parallel relationship. As a result, the longitudinal direction of the photosensitive bodies (axial line direction) and the main scanning direction of the optical write unit 70 (direction of light polarization) are parallel to each other, and the parallelity of the two can be easily managed.

As shown in FIG. 4, the photosensitive bodies (2Y, M, C, K) and optical write unit 70 of this printer are configured so that the above-described imaginary line segment between the parts to be supported described above is longer than the imaginary line segment between the two end parts of the latent image carrier. In this configuration, the front-side imaging positioning grooves (83Y, M, C, K) that serve as locations in the front-side panel 80 where the photosensitive bodies are supported and the rear-side imaging positioning grooves (93Y, M, C, K) that serve as locations in the rear-side panel 90 where the photosensitive bodies are supported are positioned in the following way. That is to say, they are positioned on the inner side in the side panel opposing direction from the front-side optical positioning grooves (81, 82) which serve as the locations in the front-side panel 80 where the optical write unit is supported and the rear-side optical positioning grooves (91, 92) which serve as the locations in the rear-side panel 90 where the optical write unit is supported. As a result, the position of the optical positioning grooves (81, 82, 91, 92) in the side panels (80, 90) and the front-side imaging positioning grooves (83Y to K, 93Y to K) in these side panels is mutually displaced in the direction of the side panel opposing direction whereupon, in turn, the degree of freedom of the layout thereof is improved. In addition, the optical positioning grooves and imaging position grooves can be provided in better positions from the viewpoint of both weight balance and vibration resistance.

As is described above, the optical write unit 70 is moved between an operate position at an opposing position to the four processing units 1Y, M, C, K and a retreat position at a non-opposing position thereto is turned by turning thereof about the shaft 100 which constitutes a shaft member between support parts that spans between the front-side panel 80 and the rear-side panel 90. In this configuration, the optical write unit 70 is moved between the operate position and the retreat position with the slide position of the optical write unit 70 with the shaft 100 being always fixed in the same position relative to the front-side panel 70 and the rear-side panel 90. As a result, the optical write unit 70 can be comparatively more easily positioned than when it is slide moved.

The left-side end part of the optical write unit 70 as one end part in the direction orthogonal to the opposing direction (one end part in the orthogonal direction between the support parts) of the two side panels (80, 90) is turnably supported by the shaft 100. A fixing device serving as fixing means (34 of FIG. 1) is arranged in the region of the right-side end part which constitutes the other end part (other end part in the orthogonal direction between the support parts) of the optical write unit 70 in the same direction therewith. In this configuration, the left-side end part of the optical write unit 70 is widely separated from the fixing device (34) to widely expose the paper conveying path of the periphery of the fixing device (34) as a result of the turning operation of the optical write unit 70. In addition, as a result, the jam processing operability in the periphery of the fixing device (34) is improved.

Figure 6:
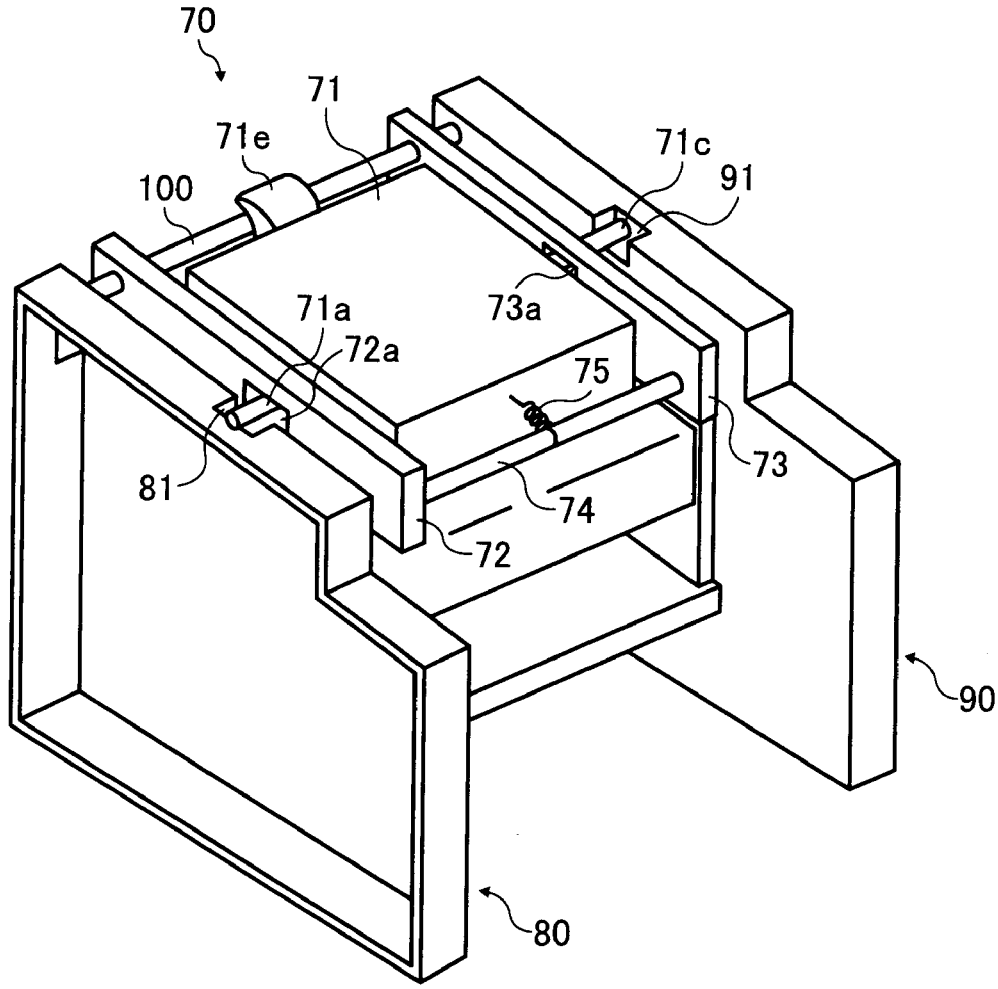
FIG. 6 is a perspective view of the inner configuration of a modification of this printer.

FIG. 6 shows the inner configuration of the apparatus of a modification of the printer pertaining to this embodiment.

The apparatus of this modification differs from the printer pertaining to the embodiment in that the casing 71 of the optical write unit 70 is supported at three locations. only the front-side first positioning shaft 71*a* protrudes from the front wall of the casing 71. In addition, only the rear-side first positioning shaft 71*c* protrudes from the rear wall. By provision of only the first positioning shafts in each of the front side and rear side in this way, the casing 71 is supported by the front frame 72 and rear frame 73 to be turnable about the shafts thereof. However, a shaft engagement part 71*e* is provided in the center in the side panel opposing direction (front-to-rear direction) of the left wall of the casing 71 and, by engagement thereof with the shaft 100, turning of the casing 71 about the positioning shaft is obstructed. Because the shaft engagement part 71*e* is provided in the center of the casing 71 in the side panel opposing direction, positioning of the casing 71 in the center in side panel opposing direction can be determined by the shaft 100.

Figure 7:
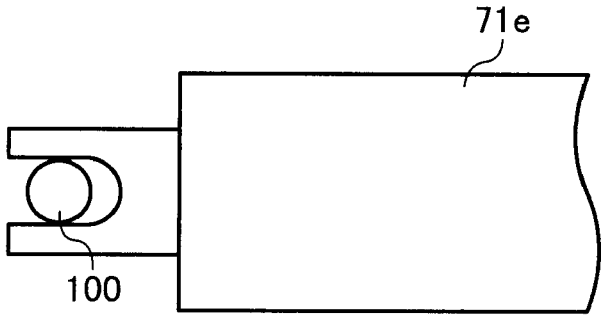
FIG. 7 is a diagram of a shaft engagement part and a shaft of the modification.

As shown in FIG. 7, the shaft engagement part 71*e* comprises a U-shaped notch portion, this notch part sandwiching the shaft 100 by means of a first linear inner wall and an opposing second linear wall thereof to afford engagement with the shaft 100. As a result of this sandwiching, a state created during turning of the optical write unit 70 about the shaft 100 in which there is play formed between the shaft engagement part 71*e* and the shaft 100 can be avoided.

80% or more of the total weight of the optical write unit 70 is supported by the front-side panel 80 and the rear-side panel 90 in this printer. As a result, the load on the shaft 100 created by the weight of the optical write unit 70 is reduced and, in turn, a drop in optical write positional accuracy caused by warp of the shaft 100 can be suppressed.

Moreover, while in the description given hitherto the front side in the direction orthogonal to the paper surface in FIG. 1 is taken as the front-face side of the printer, the right side in the diagram is taken as the right side of the printer, and the left side in the diagram is taken as the left side of the printer, the front-to-back and left-to-right directions of the printer may be established in any way as desired. For example, the right side in the diagram of FIG. 1 may be taken as the front side of the printer, the left side in the diagram may be taken as the rear side of the printer, the front side in the direction orthogonal to the paper surface may be taken as the left side of the printer, and the rear side in the direction orthogonal to the paper surface may be taken as the right side of the printer.

While the hitherto described example printers employ a single component development method for developing a latent image in which a single component developer whose main component is a toner not containing a magnetic carrier is employed, the present invention is also able to have application in an image forming apparatus in which a two-component developer method in which a two-component developer image containing a magnetic carrier and a toner is employed.

In addition, while example printers of a configuration in which the optical write unit 70 is independently turned and caused to retreat from a position opposing four processing units is described above, the present invention is also able to have application in an image forming apparatus in which a latent image writing device such as the optical write unit 70 is moved together with an opening/closing door or some other kind of member.

The employed apparatus of the printer pertaining to the embodiment and the modification thereof comprises, as a support body, the front-side panel 80 serving as a first support part for supporting a front side as one end side of the photosensitive bodies 2Y, M, C, K that serve as the latent image carriers and the optical write unit 70 that serves as the latent image writing device and the rear-side panel 90 serving as a second support part for supporting a rear side as one end side of the photosensitive bodies 2Y, M, C, K and the optical write unit 70, the location in the front-side panel 80 where the photosensitive bodies are supported and the optical write unit is supported being configured as an integrally molded part, and the location in the rear-side panel 90 where the photosensitive bodies are supported and the optical write unit is supported which constitutes a separate entity to the front-side panel 80 being configured as an integrally molded part. In this configuration, as is described above, compared to when the photosensitive bodies 2Y, M, C, K and the optical write unit 70 are supported as separate entities with mutual play therebetween, the drop in optical write positional accuracy in the front side in the axial line direction of the photosensitive bodies of the optical write unit 70 caused by relative position error of the photosensitive bodies 2Y, M, C, K and optical write unit 70 in the front side and rear side of the printer can be suppressed.

In addition, the apparatuses comprise four photosensitive bodies 2Y, M, C, K, each of the front drum shafts at one end side of these photosensitive bodies being rotatably supported by the front-side panel 80 and each of the rear drum shafts at the other end side of these photosensitive bodies being rotatably supported by the rear-side panel 90, and further comprise a transfer unit 15 serving as transfer means for superposedly transferring the Y, M, C, K toner images which are visible images developed on each of these photosensitive bodies onto the intermediate transfer belt 16 serving as the transfer body. In this configuration, because the photosensitive bodies 2Y, M, C, K and the optical write unit 70 are supported by the integrally molded front-side panel 80 and rear-side panel 90 parts described above, the drop in write positional accuracy caused by relative position error therebetween can be suppressed and, in turn, the relative position displacement (color displacement) of the color toner images on the intermediate transfer belt (16) can be suppressed.

In addition, the front-side panel 80 serving as the first support part employed in the apparatuses comprises a guide part (portion of the front-side imaging positioning groove excluding a bottom end part) for guiding the front drum shafts of one end side of the photosensitive bodies 2Y, M, C, K from the rotated operate position of the photosensitive bodies (bottom end part of the front-side imaging position determining grooves 83Y, M, C, K) to the operate position of the optical write unit 70. In addition, the rear-side panel 90 serving as the second support part employed in the apparatuses comprises a guide part (portion of the rear-side imaging positioning groove excluding a bottom end part) for guiding the rear drum shafts of the other end side of the photosensitive bodies 2Y, M, C, K from the rotating operate position of the photosensitive bodies (bottom end part of the rear-side imaging position determining grooves 93Y, M, C, K) to the operate position of the optical write unit 70. Furthermore, the front side and rear side of the photosensitive bodies 2Y, M, C, K are slide moved within the respectively correspondent guide parts to attach and detach the photosensitive bodies 2Y, M, C, K relative to the front-side panel 80 and rear-side panel 90. In this configuration, by slide movement of the photosensitive bodies 2Y, M, C, K to the operate position where there is no obstruction caused by the turning of the optical write unit 70 and slide movement to the reverse direction thereto, the photosensitive bodies 2Y, M, C, K can be easily attached and detached relative to the front-side panel 80 and the rear-side panel 90.

In addition, because an optical write unit 70 able to write latent images on each of the four photosensitive bodies 2Y, M, C, K using a single unit is employed, a more simplified positioning operation and operation for setting the latent image writing device and, in turn, better maintenancability than possible when specialist latent image writing devices for performing optical writing on each of the photosensitive bodies are separately provided is afforded.

The positioning shafts, front drum shafts and rear drum shafts of the optical write unit 70 are arranged so that an imaginary line segment between parts to be supported which constitutes a line segment that connects the front-side first positioning shaft 71*a* and the front-side second positioning shaft 71*b* serving as first support parts that while in contact with the front-side panel 80 are supported by the front-side panel 80 with the rear-side first positioning shaft 71*c* and the rear-side second positioning shaft 71*d* serving as second support parts that while in contact with the rear-side panel 90 are supported by the rear-side panel 90 is parallel with an imaginary line segment between two end parts of the latent image carrier that connect the front drum shafts and the rear drum shafts of the photosensitive bodies. In this configuration, as is described above, the longitudinal direction (axial line direction) of the photosensitive bodies and the main scanning direction (direction of light polarization) of the optical write unit 70 are parallel with each other and, accordingly, the parallelity of the two can be easily managed.

In addition, because the above-noted imaginary line segment between the parts to be supported is longer than the above-noted imaginary line segment between the two end parts of the latent image carrier, as is described above, the optical positioning grooves and imaging positioning grooves can be provided in better positions from the viewpoint of weight balance and vibration resistance.

In addition, the apparatuses comprise a shaft 100 which constitutes as shaft member between the support parts that spans between the front-side panel 80 and the rear-side panel 90, the optical write unit 70 being moved between an operate position and a retreat position as a result of being turned about the shaft 100. In this configuration, as is described above, the optical write unit 80 can be comparatively more easily positioned than when slide-moved.

In addition, a transfer device 34 serving as transfer means that is turnably supported by the shaft 100 in the left-side end part as one end part (one end part in the orthogonal direction between the support parts) of the optical write unit 70 in the direction orthogonal to the axial line direction of the shaft 100 and which fixes toner images on recording paper P on which toner images developed on the photosensitive bodies have been transferred by way of the intermediate transfer belt 16 serving as an intermediate transfer body is arranged in the region of the right-side end part as the other end part (other end part in the orthogonal direction between the support parts) of the optical write unit 70 in the same direction therewith. In this configuration, as is described above, the jam processing operability in the periphery of the fixing device 34 can be improved.

In addition, because the left-side end part of the optical write unit 70 is supported by the shaft 100 which constitutes a span member that spans between the front-side panel 80 and rear-side panel 90, the left-side end part of the optical write unit 70 can be positioned by means of the shaft 100.

In addition, by employment of the shaft 100 as the above-noted span member and support of the left-side end part of the optical write unit 70 by the shaft 100, the shaft 100 serving as the turning shaft for turning the optical write unit 70 can serve jointly as a support part of the left-side end part of the optical write unit 70.

In addition, because 80% or more of the total weight of the optical write unit 70 is supported by the direct contact between the optical write unit 70 and the front-side panel 80 and the direct contact between the optical write unit 70 and the rear-side panel 90, the load created by the weight of the optical write unit 70 on the shaft 100 can be reduced and, in turn, the drop in optical writing positional accuracy caused by warp of the shaft 100 can be suppressed.

In addition, because the photosensitive bodies 2Y, M, C, K and optical write unit 70 are supported by the each of the front-side panel 80 and rear-side panel 90 alone, a drop in optical write positioning accuracy caused by one part of the optical write unit 70 being supported by a separate entity to the member for supporting the photosensitive bodies can be avoided.

The following effects are afforded by the invention described above.

(1) The latent image writing device is separated from the latent image carrier and the peripheral devices thereof by movement of the latent image writing device from the operate position to the retreat position in accordance with need. This separation exposes the latent image carrier and the peripheral devices whereupon, in turn, the maintenancability thereof is improved.

(2) In addition, unlike in the prior art in which the latent image writing device and the latent image carriers are supported by separate entity parts formed as separate entities in respective support bodies and a relative positioning error is generated between the latent image writing device and the latent image carriers due to the play that exists between these separate entities, the latent image writing device and the latent image carriers are supported by integrally molded parts in respective support bodies and, as a result, the generation of this relative position error is avoided. Accordingly, drop in the write positional accuracy of the latent image writing device produced by relative position error between the latent image writing device and the latent image carriers can be suppressed.

Various modifications will become possible for those skilled in the art after receiving the teachings of the present disclosure without departing from the scope thereof.

What is claimed is:

1. An image forming apparatus, comprising:

a latent image carrier to carry a latent image on an endless moving surface;

a latent image writing device to optically scan the latent image carrier and form latent images on the latent image carrier, the device being movable between an operation position in which a write operation for writing a latent image on the surface is performed by the device and a retreat position in which the write operation is not performed; and a support body to support the latent image carrier and the latent image writing device, the support body being configured as an integrally molded part by being unified at a location to support the latent image carrier and a location to support the latent image writing device, wherein the support body comprises a first support part to support one end side of the latent image carrier and the latent image writing device and a second support part to support an other end side of the latent image carrier and the latent image writing device, a location to support the one end side of the latent image carrier and a location to support the one end side of the latent image writing device at the first support part being configured in the integrally molded part, and a location to support the other end side of the latent image carrier and a location to support the other end side of the latent image writing device at the second support part being configured in the integrally molded part.

2. The image forming apparatus as claimed in claim 1, further comprising:

a plurality of the latent image carriers, one end side of each of the latent image carriers being supported by the first support part and an other end side of each of the latent image carriers being supported by the second support part; and transfer means to superimposedly transfer a visible image developed on each of the latent image carriers onto a transfer body.

3. The image forming apparatus as claimed in claim 2, wherein the latent image writing device writes latent images on each of the plurality of latent image carriers using a single latent image writing unit.

4. The image forming apparatus as claimed in claim 1, wherein the first support part movably supports the one end side of the latent image carrier from an operation position of the latent image carrier to the operation position of the latent image writing device, and the second support part movably supports the other end side of the latent image carrier from the operation position of the latent image carrier to the operation position of the latent image writing device.

5. The image forming apparatus as claimed in claim 4, wherein the first support part comprises a guide part to guide the one end side of the latent image carrier from the operation position of the latent image carrier to the operation position of the latent image writing device, the second support part comprises a guide part to guide the other end side of the latent image carrier from the operation position of the latent image carrier to the operation position of the latent image writing device, and each of the one end side and the other end side of the latent image carrier being slidable in corresponding guide parts to attach and detach the latent image carrier body to the first support part and the second support part.

6. The image forming apparatus as claimed in claim 1, wherein a line segment that connects a first part to be supported that is supported by the first support part, and a second supported part to be connected that is supported by the second support part is formed parallel to an imaginary line segment between two end parts of the latent image carrier, and the line segment connects an end part of the one end side and an end part of the other end side of the latent image carrier.

7. The image forming apparatus as claimed in claim 6, wherein the line segment between the parts to be supported is longer than the imaginary line segment between the two end parts of the latent image carrier.

8. The image forming apparatus as claimed in claim 1, further comprising:

a shaft member positioned between the first and second support parts that spans between the first support part and the second support part, wherein the latent image writing device moves between the operation position and the retreat position as a result of being turned about the shaft member.

9. The image forming apparatus as claimed in claim 8, further comprising:

fixing means for fixing a visible image onto a recording member to which the visible image developed on the latent image carrier has been transferred directly or by way of an intermediate transfer body, the fixing means being arranged in a vicinity of an other end part in an orthogonal direction between the support parts, wherein one end part in an orthogonal direction between the support parts is turnably supported by the shaft member between the support parts.

10. The image forming apparatus as claimed in claim 9, further comprising:

at least one of a spanning member that spans between the first support part and the second support part and a connecting member that connects the first support part to the second support part, the one end part in the orthogonal direction between the support parts and the other end part in the orthogonal direction between the support parts of the latent image writing device being supported by the spanning member and the connecting member.

11. The image forming apparatus as claimed in claim 10, wherein the shaft member between the support parts is the spanning member, and the one end part in the orthogonal direction between the support parts is supported in the latent image writing device by the shaft member between the support parts.

12. The image forming apparatus as claimed in claim 10, wherein 80% or more of the total weight of the latent image writing device is supported by direct contact between the latent image writing device and the first support part and direct contact between the latent image writing device and the second support part.

13. The image forming apparatus as claimed in claim 1, wherein each of the latent image carrier and latent image writing device is supported by the first support part and the second support part only.

14. The image forming apparatus as claimed in claim 1, wherein the latent image carrier is rotatably supported by the first support part and the second support part.

15. The image forming apparatus as claimed in claim 1, wherein a front drum shaft of the latent image carrier is slidably moved to the operation position of the latent image writing device.

16. The image forming apparatus as claimed in claim 1, wherein a rear drum shaft of the latent image carrier is slidably moved to the operation position of the latent image writing device.

* * * * *